United States Patent [19]

Lock

[11] 4,016,797

[45] Apr. 12, 1977

[54] DUMP BAR TRANSFER MECHANISM

[76] Inventor: William E. Lock, 183 Wygant Road, Horseheads, N.Y. 14845

[22] Filed: June 18, 1976

[21] Appl. No.: 697,661

[52] U.S. Cl. ..... 89/34; 198/426

[51] Int. Cl.[2] ..... F41D 9/00

[58] Field of Search ..... 53/142, 166, 246; 86/45, 46, 47, 48; 89/34; 198/426, 472, 484; 214/1 BB, 1.1, 8.5 A, 8.5 C

[56] References Cited

UNITED STATES PATENTS 3,732,969 5/1973 Formo ..... 198/426

*Primary Examiner*—Stephen C. Bentley
*Attorney, Agent, or Firm*—Joseph E. Rusz; Arsen Tashjian

[57] ABSTRACT

The mechanism accurately removes rounds of ammunition from a moving horizontal conveyor and places them into a stationary partitioned tray which is disposed below both the inventive mechanism and the conveyor. The mechanism comprises two counter-rotating dump bars driven by an indexing drive assembly which, in turn, comprises a combination of geneva-type indexing drive units and conventional gearing. The indexing drive assembly provides the dump bars with a 16-to-1 dwell-to-drive ratio, and rotates the bars 90° each actuation. The dump bars have guiding surfaces across which the rounds of ammunition are moved by elements of the horizontal conveyor, while the dump bars are in the locked dwell position. When the dump bars are full of rounds, the bars index and transfer the rounds out of the conveyor elements and into the tray for subsequent operations, without interaction with, or interference by, the conveyor. Adjacent rounds that follow the original rounds then begin to fill the bars, and the operation is repeated in a cyclic manner.

8 Claims, 6 Drawing Figures

DUMP BAR TRANSFER MECHANISM

STATEMENT OF GOVERNMENT INTEREST

The invention described herein may be manufactured and used by or for the Government for governmental purposes without the payment of any royalty thereon.

CROSS REFERENCE TO RELATED APPLICATION

The dump bar transfer mechanism taught herein may be used as a cooperating component in the inventive system set forth in my copending application Ser. No. 697,662 entitled, "Automated Ammunition Loading-/Downloading Systems", filed on even date herewith.

BACKGROUND

This invention relates to a dump bar transfer mechanism and, more particularly, to an adaptation thereof for use in accurately removing a plurality of rounds of ammunition from a moving horizontal conveyor that is carrying the rounds of ammunition.

One particular application of such as adaptation of my dump bar transfer mechanism is illustrated in my copending application entitled, "Automated Ammunition Loading/Downloading System", filed on even data herewith.

This invention permits the removing of items vertically downward from a moving horizontal conveyor and the urging (and placing) of the items into horizontally-positioned stationary trays, whereat the items can be moved perpendicularly to the motion of the horizontal conveyor without interaction with or interference from the conveyor. Thereby, I have significantly advanced the state-of-the-art.

SUMMARY OF THE INVENTION

This inventive dump bar transfer mechanism pertains to a particular preferred embodiment adapted for use in rapidly removing rounds of ammunition from conveyor elements, and providing precise placement (by urging, such as by "dumping") of the rounds of ammunition into the next scheduled physical position.

Accordingly, the principal object of this invention is to teach the structure of such a preferred embodiment of the invention.

This principal object, as well as other related objects, of this invention will become readily apparent after a consideration of the description of my invention, coupled with reference to the Figures of the drawings.

DESCRIPTION OF THE PREFERRED EMBODIMENT

Figure 1:
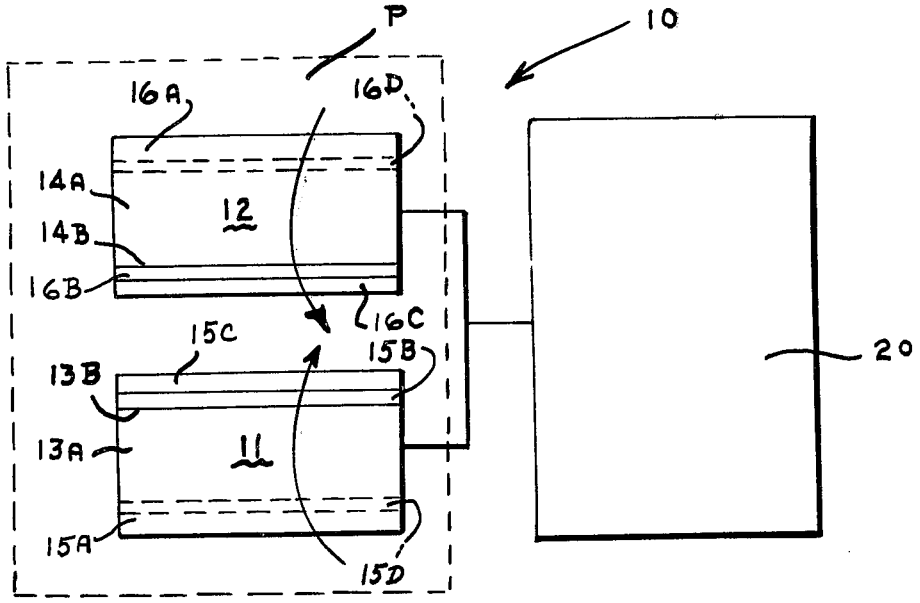
FIG. 1 is a simplified, block diagram representation of the invention in its most generic structural form.

With reference to FIG. 1, therein is shown a simplified, block-diagram representation of the generic form of a preferred embodiment 10 of my invention.

In its most basic structural form, the embodiment 10 comprises: a plurality of rotatable dump bars, such as first dump bar 11 and second dump bar 12, in parallel spaced-apart relationship to each other, with each dump bar having a plurality of intersecting planar surfaces, such as 13A and 13B of first dump bar 11, and 14A and 14B of second dump bar 12, with each surface having an extension (or ammunition guiding surface), such as 15A, 15B, 15C and 15D for first dump bar 11, and 16A, 16B, 16C and 16D for second dump bar 12; and, means 20 for selectively rotating each rotatable dump bar, such as 11 and 12, with the rotating means 20 operatively associated with each dump bar by suitable conventional means.

As shown by the curved directional arrows in FIG. 1, the dump bars 11 and 12 are counter-rotatable.

Figure 2:
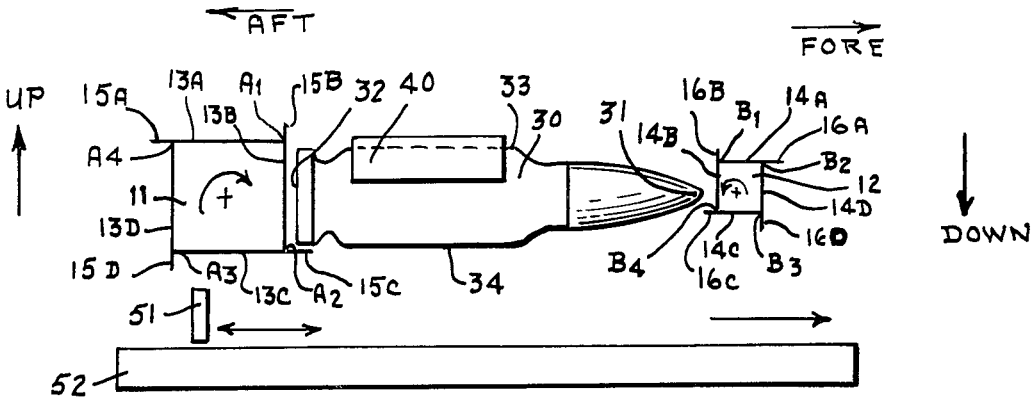
FIG. 2 is a side elevation view, in simplified form, partially pictorial and partially schematic, of some major elements of the invention in their working environment.

Now, with reference to FIG. 2, the plurality of intersecting planar surfaces of first dump bar 11 (i.e., 13A, 13B, 13C and 13D) and of second dump bar 12 (i.e., 14A, 14B, 14C and 14D) can be easily seen. The surface extensions of first dump bar 11 (i.e., 15A, 15B, 15C and 15D) and of second dump bar 12 (i.e., 16A, 16B, 16C and 16D) are also easily seen.

First and second dump bars 11 and 12 are essentially in the same plane, such as "P", FIG. 1, and, as a matter of preference rather than of limitation, the plane "P" is horizontal. Also as a matter of preference, the first and second dump bars 11 and 12 each have four intersecting planar surfaces forming four intersections with a dihedral angle of 90° at each intersection (i.e., angles A1, A2, A3 and A4 as to first dump bar 11; and angles B1, B2, B3 and B4 as to second dump bar 12), as shown in FIG. 2. The vertical cross section of each dump bar, as shown in FIG. 2, is preferably a square.

Also shown in FIG. 2 are: a representative round of ammunition 30 being transferred by a moving horizontal conveyor (not shown), a conveyor element 40 which is releasably holding the ammunition round 30; a push bar 51 positioned below dump bars 11 and 12 and ammunition round 30, with the push bar 51 being horizontally transversely movable fore and aft, as indicated by the double-headed arrow; and a stationary tray 52 that is partitioned transversely and that is horizontally-positioned below the push bar 41 and, of course, below the dump bars 11 and 12 and below the round 30 to be transferred.

The round of ammunition 30, FIG. 2, has a fore end 31, an aft end 32, an upwardly facing external surface portion 33, and a downwardly facing external surface portion 34.

Further, the horizontally-moving conveyor (of which ammunition round holder or carrier 40 is an element) and the horizontally-positioned stationary tray 52 are, as a matter of preference, in equal spaced-apart relationship.

Still with reference to FIG. 2, the first dump bar 11 is disposed aft of the aft end 32 of representative ammnunition round 30, while the second dump bar 12 is disposed fore of the fore end 31 of the round 30. The extension or guiding surface (such as 15C) of one of the intersecting planar surfaces (such as 13C) of the first dump bar 11 abuts the downwardly facing external portion 34 of the aft end 32 of representative round 30; and, the extension or guiding surface (such as 16C) of one of the intersecting planar surfaces (such as 14C) of the second dump bar 12 abuts the downwardly facing portion 34 of the fore end 31 of round 30.

Figure 3:
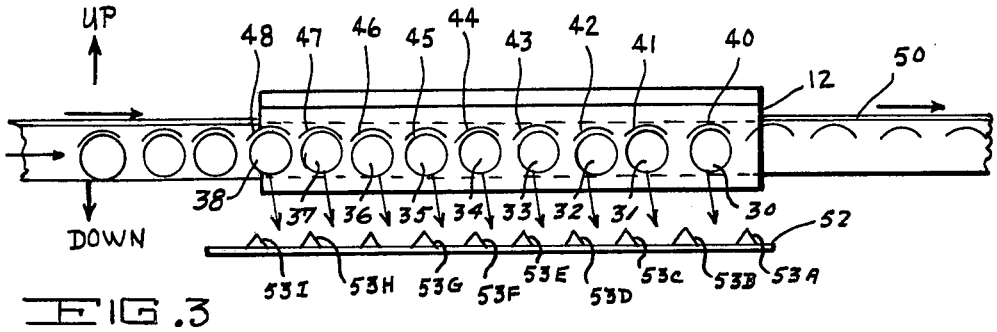
FIG. 3 is a front view, in simplified form, also partially pictorial and partially schematic, of the same major elements and working environment that were shown in FIG. 2.

Now, with reference to FIG. 3, which is a front view of the components shown in FIG. 2, less the first dump bar 11, FIGS. 1 and 2, and the push bar 51, FIG. 2, so that the positional relationship of the rounds of ammunition and other items may be better seen. Easily seen are second (fore) dump bar 12, moving horizontal conveyor 50, a plurality of conveyor elements (such as representative ones 40–48, inclusive) that are connected to the horizontal conveyor 50, stationary tray 52 with partitions (such as representative ones 53A–53I, inclusive) that are transverse to the movement of the horizontal conveyor 50, and parallel to and below the rounds of ammunition.

Figure 4:
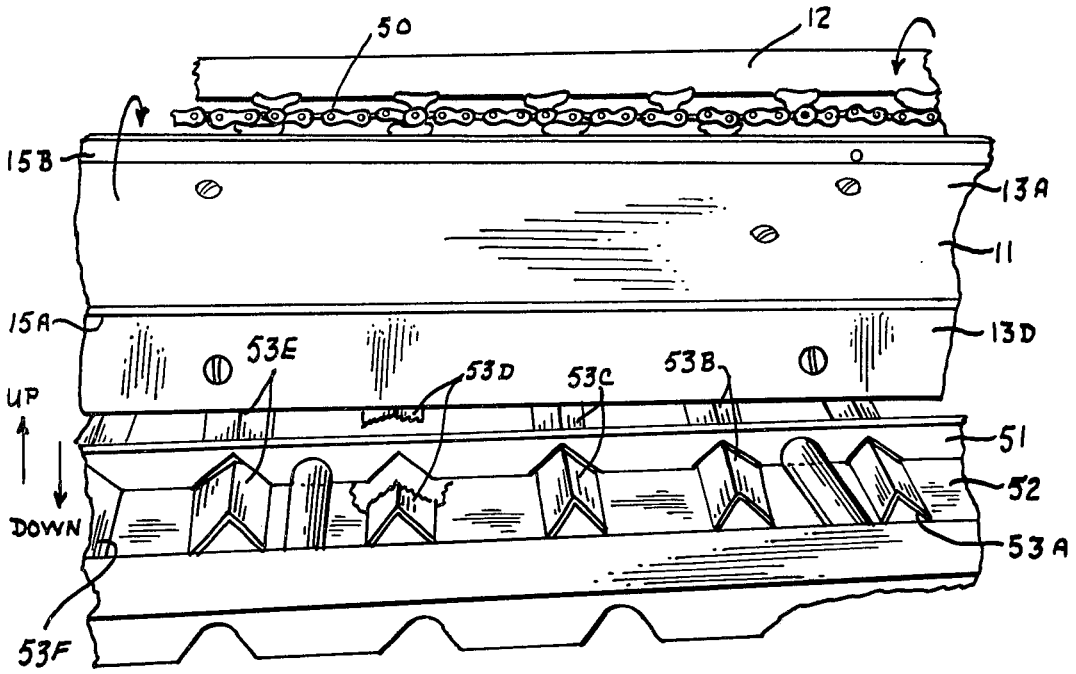
FIG. 4 is a pictorial representation of the front view of some of the major elements of the preferred embodiment in the working environment.

With reference to FIG. 4, therein is a close-up pictorial representation of the components shown in FIGS. 2 and 3, including the first dump bar 11, but less the rounds of ammunition. Easily seen, in their relative positional relationship, are: second dump bar 12, with a rotational arrow to designate its direction of rotation; moving horizontal conveyor 50; first dump bar 11, likewise with a rotational arrow, and with representative intersecting planar surface 13A and 13D, representative planar surface extensions (or "guide surfaces") 15B and 15A; stationary horizontal tray 52 with representative transverse partitions 53A–53F, inclusive; and, push bar 51.

Figure 5:
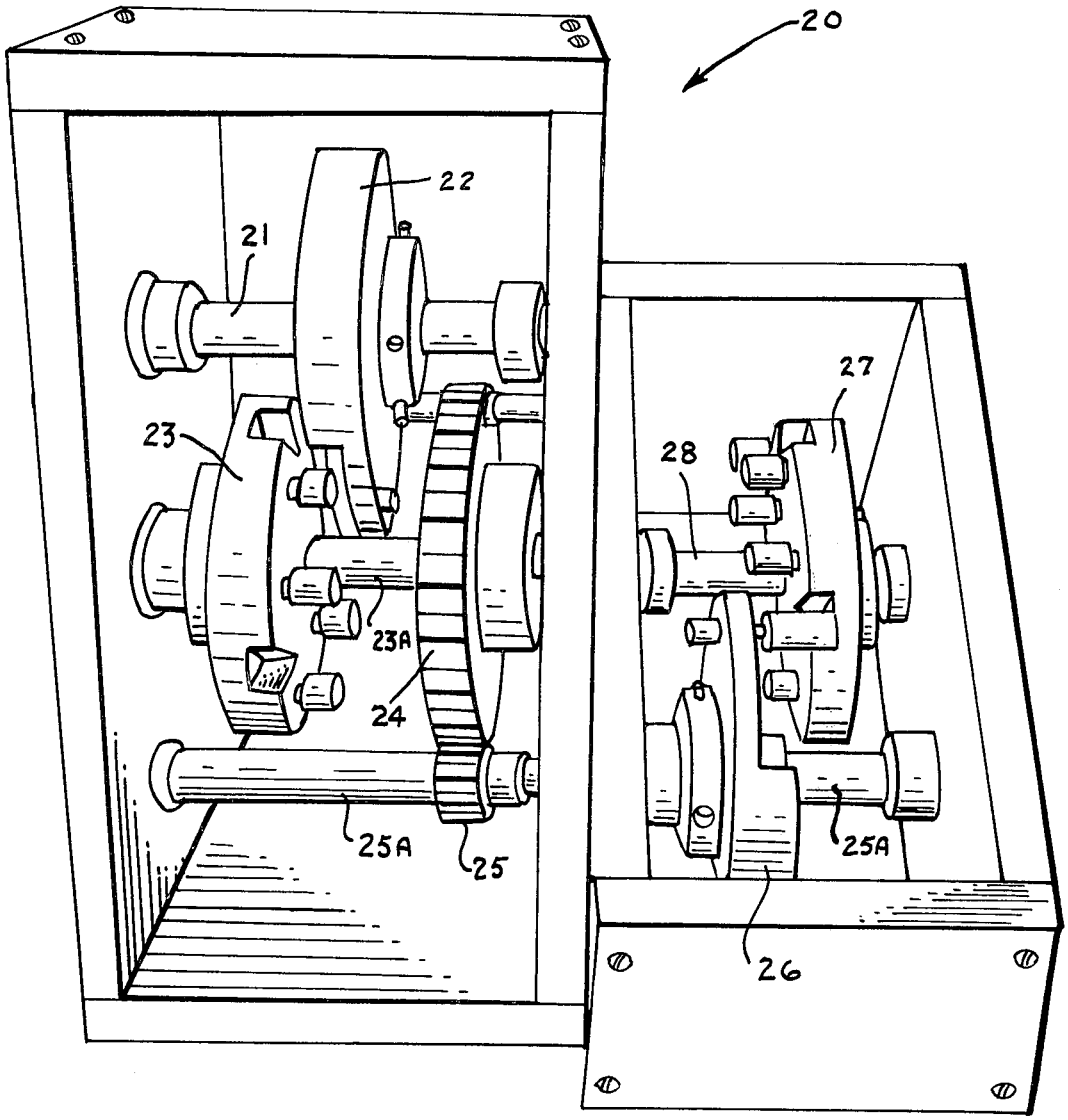
FIG. 5 is a pictorial representation of the other major elements of the preferred embodiment of the invention; and, FIG. 6 is a side elevation view, in simplified schematic form, of a variation of the invention.

In FIG. 5 is shown, principally in pictorial form, the preferred components which collectively comprise the means 20, FIG. 1, for selectively rotating each rotatable dump bar, such as 11 and 12, FIGS. 1–4, inclusive. In essence, the means 20 comprises a series of coacting geneva-type drive mechanisms with associated spur gears to provide a preferred 16-to-1 dwell-to-drive ratio for the output shaft 28.

Means 20 (hereinafter referred to as the "indexing drive assembly") preferably comprises: a rotatable input drive shaft 21; a primary driver element 22 disposed on the input drive shaft 21; a primary driven wheel 23 disposed on a rotatable first drive shaft 23A and driven by the primary driver element 22; a first tooth spur gear 24, having a preselected number of gear teeth (preferably 60 gear teeth), disposed on the first drive shaft 23A; a second tooth spur gear 25 disposed on a rotatable second shaft 25A and engaged with the first tooth spur gear 23, with the second gear 25 having a preselected number of gear teeth that are less in number then the preselected number of gear teeth of the first tooth spur gear (e.g., if the first gear 23 has 60 teeth, then it is preferred that the second gear 25 have 25 teeth); a secondary driver element 26 disposed on the rotatable second shaft 25A; a secondary driven wheel 27 driven by the secondary driver element 26; and, a rotatable output shaft 28 on which is disposed the secondary driven wheel 27.

MANNER OF OPERATION OF THE PREFERRED EMBODIMENT

As a matter of preference, rather than of limitation, my inventive dump bar transfer mechanism is cyclic every nine rounds of ammunition.

It is here to be remembered that, in this adaptation of my invention, ammunition rounds are the items to be removed from a moving horizontal conveyor 50, FIGS. 3 and 5, and to be transferred to another position, where the items can then be handled without interference with or from the horizontal conveyor 50.

Also it is to be remembered that in the generic sense the invention may be said to comprise, in an oversimplification: two counter-rotating dump bars 11 and 12, FIGS. 1–4, inclusive, with "guiding surfaces" (i.e., surface extensions), such as 15A–15D, inclusive, FIGS. 1 and 2, for dump bar 11, and 16A–16D, inclusive, FIG. 1 and 2, for dump bar 12; and, operatively associated with each dump bar 11 and 12, an indexing drive unit 20, FIGS. 1 and 5, that rotates the dump bars 11 and 12 and also holds them in a stationary locked position, while the dump bars are "loaded" by the conveyor elements, such as 40, FIG. 2, and 40–48, inclusive, FIG. 3.

The two dump bars 11 and 12 dwell in a stationary locked position as the moving horizontal conveyor elements, such as 40, FIG. 2, and 40-48, inclusive, FIG. 3, move the rounds such as 30–38, inclusive, FIG. 3, across the dump bar guide surfaces (i.e., the planar surface extensions, such as 15C and 16C in FIG. 2 where round 30 is being across 15C and 16C). When a predetermined number of rounds, such as nine in this case, have been drawn onto the dump bars, the dump bars rotate (i.e., are rotated) 90° toward each other. This forces the nine rounds that have been loaded onto the dump bars, vertically downward into the stationary tray 52. In this particular adaptation of my invention, the force of gravity assists the "transfer" because it is vertically downward. The 90° indexed rotation brings new dump bar guide surfaces into position to hold the next nine rounds to be loaded. This rotation must be completed before the first of the next nine rounds is drawn onto the dump bar by the conveyor elements that are moving at constant speed. As this second group of rounds if loaded onto the dump bars, those "transferred" to the tray are free to be moved by the push bar 51, FIGS. 3 and 5, perpendicularly to the direction of motion of the horizontal conveyor. The push bar 51 is returned to the position shown in FIG. 2, before the next nine rounds are "transferred" to the tray 52. This operation is repeated continuously in a cyclic manner.

With reference to FIG. 5, the indexing drive assembly 20 comprises geneva-type drive mechanisms and spur gears which provide, preferably, a 16-to-1 dwell-to-drive ratio for the output shaft 28. Thus, for 337.5° of rotation of the input drive shaft 21 during one 360° rotation of that shaft, the output shaft 28 remains in a motionless locked position. During the next 22.5° of the input drive shaft 21 rotation, the output shaft 28 rotates 90°. This motion is repeated in a cyclic operation to drive the dump bars 11 and 12.

CONCLUSION

It is abundantly clear from all of the foregoing, and from the contents of the Figures of the drawings herein, that the stated principal object of my invention has been attained.

Figure 6:
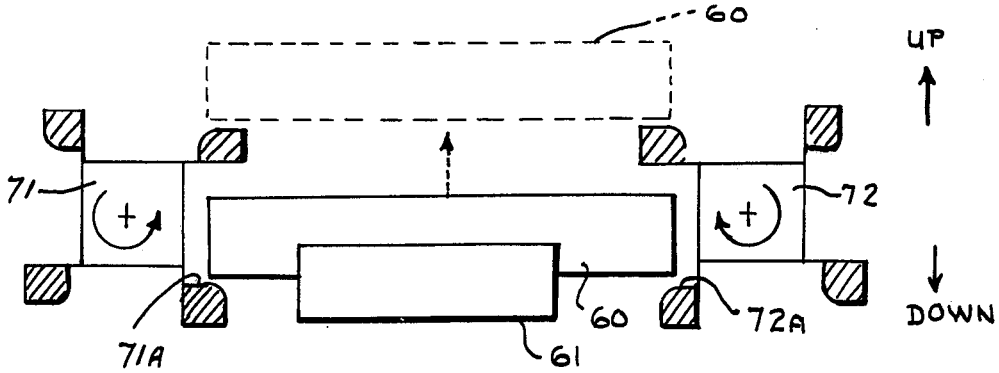

It is to be noted that, although there have been described the fundamental and unique features of my inventive dump bar transfer mechanism as applied to a particular preferred embodiment that is adapted for a specific use, various other embodiments, adaptations, substitutions, additions, omissions, and the like may occur to, and may be made by, those of ordinary skill in the art, without departing from the spirit of my invention. For example, and with reference to FIG. 6: The length and the shape of the dump bars and the dwell-to-drive ratios of the indexing-type drive unit can be arranged to accomodate a wide range of items with varying shapes in varying quantities for each cycle. As can be seen by examination of FIG. 6, my basic structural concept can be applied to transfer, or otherwise to move, an item (such as a cylinder) vertically upward. More specificially, and with continued reference to FIG. 6, the cylinder 60, removably held in conveyor element 61, is transferred vertically upward by guiding surfaces (or surface extensions), such as 71A of dump bar 71, and 72A of dump bar 72, as the dump bars 71 and 72 are rotated toward each other (i.e., counter-rotated) by suitable means, such as an indexing drive assembly similar to the one disclosed herein.

What is claimed is:

1. A dump bar transfer mechanism, adapted for use in accurately removing a plurality of rounds of ammunition from a moving horizontal conveyor that is carrying said rounds of ammunition, and urging the removed rounds of ammunition into a horizontally-positioned, partitioned stationary tray, wherein each round of ammunition has a fore end, an aft end, an upwardly facing external surface portion, and a downwardly facing external surface portion having a fore end and an aft end, and wherein the moving conveyor and the stationary tray are in equal spaced-apart relationship, comprising:

a. a plurality of rotatable dump bars, in parallel spaced relationship to each other, interposed between the moving conveyor and the stationary tray, wherein each said dump bar of said plurality has a plurality of intersecting planar surfaces, with each surface having an extension;

b. and, means for selectively rotating each said rotatable dump bar, with said rotating means operatively associated with each said rotatable dump bar.

2. A dump bar transfer mechanism, as set forth in claim 1, wherein said plurality of rotatable dump bars comprises a first dump bar and a second dump bar that are counter-rotatable in relationship to each other, with said first and second dump bars each having four intersecting planar surfaces forming four intersections with a dihedral angle of 90° at each said intersection, and wherein:

a. said first dump bar is disposed aft of said aft end of each said round of ammunition that is carried on the moving conveyor;

b. said second dump bar is disposed fore of said fore end of each said round of ammunition that is carried on the moving conveyor;

c. the extension of one of said intersecting surfaces of said first dump bar abuts said downwardly facing external portion of each said round of ammunition that is carried on the moving conveyor;

d. and, the extension of one of said intersecting surfaces of said second dump bar abuts said downwardly facing external portion of each said round of ammunition that is carried on the moving conveyor.

3. A dump bar transfer mechanism, as set forth in claim 2, wherein said means for selectively rotating each said rotatable dump bar includes:

a. means for rotating said first dump bar in a preselected direction;

b. means for rotating said second dump bar in a direction opposite to the preselected direction of rotation of said first dump bar, simultaneously with and during the rotation of said first dump bar;

c. and, means for holding said first and second dump bars in a controlled locked dwell position for a predetermined length of time.

4. A dump bar transfer mechanism, as set forth in claim 3, wherein said predetermined length of time during which said first and said second dump bars are held in a controlled locked dwell position equals 16 times the length of time that said first dump bar rotates and that said second dump bar simultaneously counter-rotates.

5. A dump bar transfer mechanism, as set forth in claim 3, wherein said means for selectively rotating each said rotatable dump bar comprises an indexing drive assembly which includes:

a. a rotatable input drive shaft;

b. a primary driver element disposed on said input drive shaft;

c. a primary driven wheel disposed on a rotatable first shaft and driven by said primary driver element;

d. a first tooth spur gear having a preselected number of gear teeth and disposed on said first shaft;

e. a second tooth spur gear disposed on a rotatable second shaft and engaged with said first tooth spur gear, with said second tooth spur gear having a preselected number of gear teeth that are less in number than the preselected number of gear teeth of the first spur gear;

f. a secondary driver element disposed on said rotatable second shaft;

g. a secondary driven wheel driven by said secondary driver element;

h. and, a rotatable output shaft on which is disposed said secondary driven wheel.

6. A dump bar transfer mechanism, as set forth in claim 2, wherein said first and second dump bars are essentially in the same plane.

7. A dump bar transfer mechanism, as set forth in claim 6, wherein said plane containing said first and second dump bars is horizontal.

8. A dump bar transfer mechanism, as set forth in claim 5, wherein:

a. said first tooth spur gear has 60 gear teeth;

b. and, said second tooth spur gear has 15 gear teeth.

* * * * *